United States Patent [19]

Yoder

[11] 4,054,037

[45] Oct. 18, 1977

[54] PORTABLE APPARATUS FOR SEQUENTIALLLY COOLING A PLURALITY OF CONTAINERS OF BEVERAGES AND THE LIKE

[75] Inventor: Michael C. Yoder, Lincolnton, N.C.

[73] Assignee: Paul C. Rhyne, Jr., Lincolnton, N.C.; a part interest

[21] Appl. No.: 594,204

[22] Filed: July 9, 1975

[51] Int. Cl.[2] ..... F25D 3/10; F25D 3/08

[52] U.S. Cl. ..... 62/224; 62/457; 62/530; 62/371; 62/294

[58] Field of Search ..... 62/293, 294, 457, 530, 62/371, 224; 137/102, 624.27 X; 222/52

[56] References Cited

U.S. PATENT DOCUMENTS

| | | | |
|---|---|---|---|
| 2,773,358 | 12/1956 | Palmer et al. | 62/294 |
| 2,805,556 | 9/1957 | Wang | 62/294 |
| 2,883,835 | 4/1959 | Pikey | 62/457 |
| 3,148,515 | 9/1964 | Jentis et al. | 62/371 |
| 3,633,381 | 1/1972 | Haaf et al. | 62/457 |
| 3,800,552 | 4/1974 | Sollami et al. | 62/293 |
| 3,959,982 | 6/1976 | Denis et al. | 62/223 |

*Primary Examiner*—Lloyd L. King
*Attorney, Agent, or Firm*—Bell, Seltzer, Park & Gibson

[57] ABSTRACT

A portable apparatus for sequentially cooling a pluraity of containers of beverages and the like includes a portable housing containing the following devices. An evaporator circulates a refrigerant therethrough and defines a receptacle for receiving a container to be cooled in close heat-conducting relation thereto. A supply tank initially contains pressurized refrigerant sufficient for cooling a plurality of containers. A conduit transmits the pressurized refrigerant from the supply tank to the evaporator. A valve forms a part of the conduit and includes devices for actuating the valve to allow the flow of pressurized refrigerant from the supply tank and devices responsive to the flow of a predetermined quantity of refrigerant from the supply tank sufficient for cooling a single container for deactuating the valve device to stop the flow of refrigerant from the supply tank and provide the predetermined quantity of refrigerant to the evaporator for cooling the container received in the receptacle.

10 Claims, 15 Drawing Figures

PORTABLE APPARATUS FOR SEQUENTIALLLY COOLING A PLURALITY OF CONTAINERS OF BEVERAGES AND THE LIKE

This invention relates to a portable apparatus for sequentially cooling a plurality of containers of beverages and the like along with the subcombinations of apparatus for metering a predetermined quantity of a pressurized fluid to any suitable device and a pressure responsive metering valve for allowing passage therethrough of a predetermined quantity of pressurized fluid.

BACKGROUND OF THE INVENTION

There is a need for a portable apparatus for sequentially cooling a plurality of containers of beverages and the like, particularly for fishermen, sportsmen and others who desire to cool containers of beer or other beverages when participating in or witnessing a sports event or the like or for travelers and others who do not have access to the normal home refrigerating mechanisms.

While portable refrigerators have hertofore been proposed, all of the prior designs of such portable refrigerating apparatus have suffered from one or more drawbacks and design deficiencies, particularly in the size of these prior devices, the complicated nature of their design and operation and the inability to sequentially cool a plurality of containers of beverages one at a time from a single supply of refrigerant portably carried therein.

Examples of such previously proposed refrigerating apparatus may be seen in the following United States Patents considered with respect to the present invention:

| Patent Number | Inventor | Issue Date |
|---|---|---|
| 735,403 | E. F. Osborne | August 4, 1903 |
| 1,630,077 | F. W. Schwinn | May 24, 1927 |
| 1,918,970 | D. F. Keith | July 18, 1933 |
| 2,214,344 | L. R. Paul | September 10, 1940 |
| 2,480,813 | D. C. Prince | August 30, 1949 |
| 2,742,768 | A. H. Baer | April 24, 1956 |
| 2,805,556 | W. Wang | September 10, 1957 |
| 2,812,643 | F. Worschitz | November 12, 1957 |
| 2,900,808 | W. Wang | August 25, 1959 |
| 3,041,852 | J. H. Palmer | July 3, 1962 |
| 3,108,451 | A. F. Clifford | October 29, 1963 |
| 3,410,109 | H. R. Maryland | November 12, 1968 |
| 3,585,813 | C. C. Hansen et al | June 22, 1971 |
| 3,633,381 | P. A. Haaf et al | January 11, 1972 |

OBJECTS AND SUMMARY OF THE INVENTION

Accordingly, it is the object of this invention to provide a portable apparatus for sequentially cooling a plurality of containers of beverages and the like of improved design and which overcomes problems presented with previously proposed portable refrigerating apparatus.

By this invention, it has been found that the above object may be accomplished by providing such apparatus, broadly as follows. A portable housing is provided for being self-containing and carrying all of the elements of the apparatus for easy transportation with the user of the apparatus. Evaporator means circulate a refrigerant therethrough and define therewithin a receptacle for receiving a container to be cooled in close heat-conducting relation thereto. A supply tank is provided for initially containing a supply of pressurized refrigerant sufficient for cooling a plurality of containers one at a time. Conduit means communicate with the evaporator means and the refrigerant supply tank for transmitting the pressurized refrigerant from the supply tank to the evaporator means. Valve means form a part of the conduit means and include means for actuating the valve means to allow the flow of pressurized refrigerant from the supply tank and means responsive to the flow of a predetermined quantity of refrigerant from the supply tank sufficient for cooling a single container for deactuating the valve means to stop the flow of refrigernat from the supply tank and provide the predetermined quantity of refrigerant to evaporator means for cooling the container received in the receptacle.

In accordance with the above described broad design of the portable apparatus for sequentially cooling a plurality of containers of beverages and the like, it was determined to be a further object to provide a pressure responsive metering valve for allowing passage therethrough of a predetermined quantity of pressurized fluid.

In accordance with this invention, this object may be accomplished by providing a valve comprising, the following. A valve housing is provided having a longitudinally extending bore therein. An inlet port extends through the housing to the bore for receiving pressurized fluid. A discharge port extends through the housing to the bore at a longitudinally spaced position from the inlet port for discharging pressurized fluid. A valve core is positioned in the bore of the valve for being moved between an actuated position establishing fluid flow between the inlet port and the discharge port and a deactuated position preventing fluid flow between the inlet port and the discharge port. Means are provided for biasing the valve core into the deactuated position thereof. A manually depressable valve core shifting means is provided for moving the valve core from the deactuated to the actuated positions thereof and a latch means is provided for holding the valve means in the actuated position thereof against the bias of the biasing means. A pressure sensitive bellows means is connected with the latch means and with the discharge port and is responsive to a predetermined fluid pressure in the discharge port indicating that a predetermined quantity of pressurized fluid has flowed through the valve means for deactuating the valve means by unlatching the latch means to allow the valve means to return under the influence of the biasing means to the unactuated position thereof.

Also, in accordance with the above-described broad design of the portable apparatus for sequentially cooling a plurality of containers of beverages and the like, it was determined to be a still further object of this invention to provide suitable designs of apparatus for metering a predetermined quantity of a pressurized fluid to a suitable device, such as to an evaporator of a refrigeration system.

In accordance with this invention, it was determined that this above object may be accomplished by providing, firstly, such an apparatus comprising, the following. A supply tank is provided for containing a supply of pressurized fluid. A metering tank receives a predetermined amount of pressurized fluid from the supply tank. Conduit means communicate with the supply tank and the metering tank and have an exit for transmitting the pressurized fluid from the supply tank to the metering tank and from the metering tank to the exit. Valve means, such as described above, form a part of the conduit means and include means for actuating the valve means to allow the flow or pressurized fluid from the supply tank to the metering tank while preventing the flow of pressurized fluid from the metering tank to the exit and means responsive to the flow of a predetermined quantity of pressurized fluid from the supply tank to the metering tank for deactuating the valve means to stop the flow of pressurized fluid from the supply tank to the metering tank and to allow the flow of the predetermined quantity of pressurized fluid from the metering tank to the exit.

Also, it was determined that the last above set forth object may be accomplished by providing, secondly, such an apparatus comprising, the following. A supply tank is provided for containing a supply of pressurized fluid. Conduit means communicate with the supply tank and have an exit for transmitting the pressurized fluid from the supply tank to any suitable device and include a fixed resistance orifice means in the conduit means generally at the exit for resisting the flow of pressurized fluid therethrough and for creating an increasing back pressure in the conduit means as the pressurized fluid flows therethrough. Valve means, such as described above, form a part of the conduit means and include means for actuating the valve means to allow the flow of pressurized fluid from the supply tank to the exit and pressure responsive means responsive to the flow of a predetermined quantity of pressurized fluid from the supply tank through the exit which causes a predetermined back pressure through the conduit means and the valve means for deactuating the valve means for stopping the flow of pressurized fluid from the supply tank through the exit.

Further details of specific preferred embodiments of this invention will be given in the detailed description to follow.

BRIEF DESCRIPTION OF THE DRAWINGS

Some of the objects and advantages of this invention having been set forth, other objects and advantages will be seen from the following more detailed description, when taken in conjunction with the accompanying drawings, in which.

DESCRIPTION OF PREFERRED EMBODIMENTS

Figure 1:
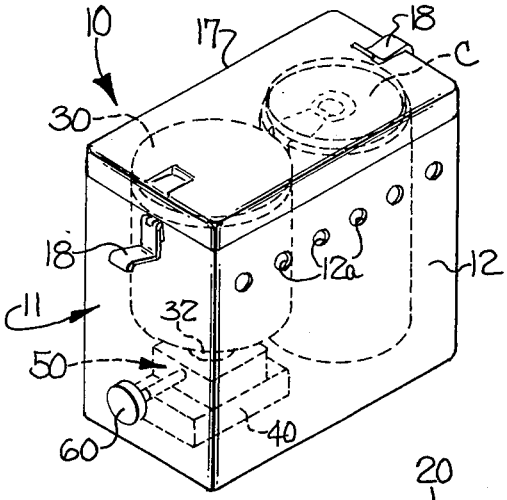
FIG. 1 is a perspective view of a first form of portable apparatus in accordance with this invention.
Figure 2:
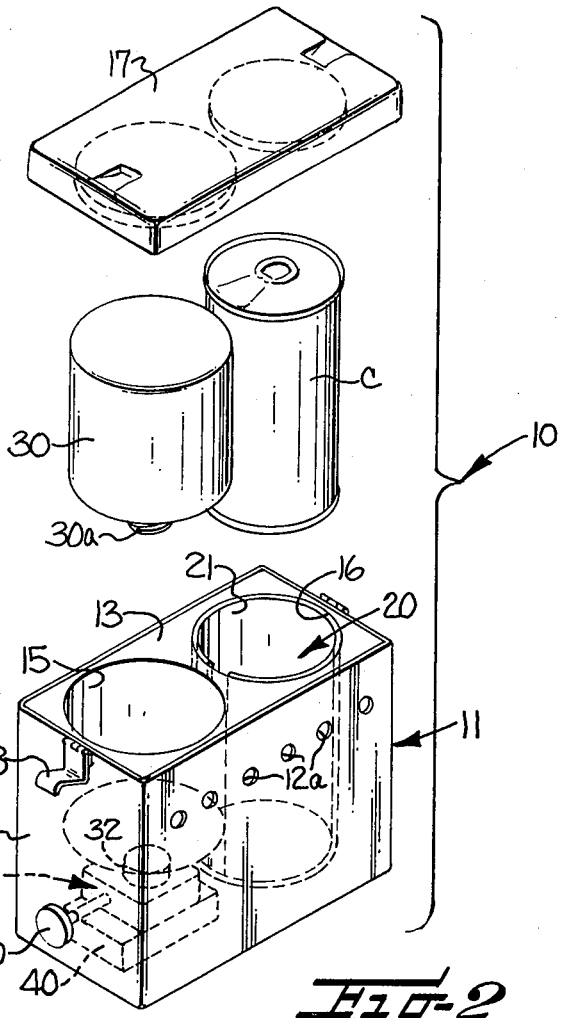
FIG. 2 is an exploded view of the apparatus of FIG. 1.

Referring now to the drawings, the apparatus for sequentially cooling a plurality of containers C of beverages and the like is generally indicated at the reference numeral 10. A first embodiment or design of such portable apparatus 10 is illustrated in FIGS. 1–11 and will be described firstly, and a second embodiment of such portable apparatus 10' is illustrated in FIGS. 12–15 and will be described secondly. However, it is to be understood that certain features from the first embodiment of portable apparatus 10 could be utilized in the second embodiment of portable apparatus 10' and vice versa and that features from either of these embodiments could be utilized in portable apparatus in accordance with this invention of other specific designs.

Referring now specifically to FIGS. 1–11, the portable apparatus 10 for sequentially cooling a plurality of containers C of beverages and the like comprises generally a portable housing, collectively indicated at 11. This portable housing preferably comprises an outer shell 12 of generally rectangular, cross-sectional, configuration and includes a bottom wall, opposing pairs of side walls and an open top, as may be seen clearly in FIGS. 1, 2 and 3. The outer shell 12 further includes ports **12*a* extending therethrough for purposes to be described below. While the generally rectangular, cross-sectional, configuration is preferred, other configurations may be utilized in accordance with the novel concepts of this invention. The shell 12 of the housing 11** should be abrasion resistant, impact resistant and have a durable finish and it has been found that this shell may be formed of polycarbonate plastic material for this purpose.

The portable housing 11 further includes insulation 13 disposed within the shell 12 and defining a pair of side-by-side, spaced apart, cavities 15, 16 therein. The insulation may be any material which is preferred of low thermal conductivity, low temperature resistant and resistant to chemical degradation by refrigerants. It has been found that stabilized polyurethane foam is suitable for such insulation.

The portable housing 11 may further include a top portion 17 covering the open top of the shell 12 and which may be formed of the same components, i.e. a shell and insulation, as the remainder of the portable housing 11 for covering the cavities 15, 16 in the insulation 13. The top portion 17 should be at least partially movable to open one or both of the cavities 15, 16. As shown in this first embodiment of portable apparatus 10 of FIGS. 1–11, the top portion 17 is completely removable to expose both of the cavities 15, 16 and is held in place over these cavities by pivotally mounted brackets 18 which may be moved to allow removal of the top portion 17.

The portable apparatus 10 further includes evaporator means 20 carried by the housing 11 and positioned within the cavity 16 of the insulation 13 thereof. The evaporator means 20 defines a receptacle 21 therein for receiving a container C to be cooled in close heat-conducting relation thereto.

More specifically, the evaporator means 20 comprises a substantially smooth and generally cylindrical inner wall 23 and an outer wall 24 extending substantially around the inner wall and being contiguous therewith and having undulations **24*a* therein for forming with the inner wall 23 a continuous serpentine passageway 25 (FIGS. 4 and 6) for the flow of refrigerant through the evaporator means 20. The inner wall and the outer wall are sealed to each other at portions other than at the undulations 24*a* of the inner wall 24. The inner and outer walls 23, 24** thereof should be constructed of a high thermal conductivity material and it has been found that copper is a suitable material.

The evaporator means 20 further includes a vent 26 communicating with the serpentine passageway 25 for releasing the refrigerant after circulation therethrough into the insulation 13 for flow therethrough and out of the ports **12*a* formed in the shell 12 of the housing 11** for venting the refrigerant to the atmosphere and for obtaining additional circulation of the refrigerant to enhance cooling. This also provides an open cycle refrigeration system in conjunction with the other components to be described below.

Figure 4:
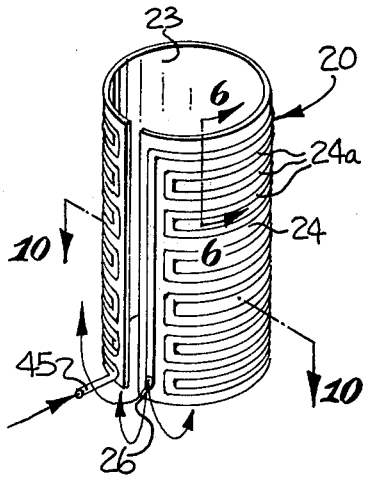
FIG. 4 is a perspective view of the evaporator means of the apparatus of FIG. 1.
Figure 6:
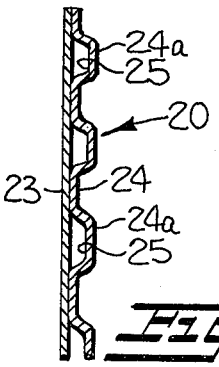
FIG. 6 is a cross-sectional detail through the evaporator means of FIG. 4 and taken generally along the lind 6—6 of FIG. 4.
Figure 7:
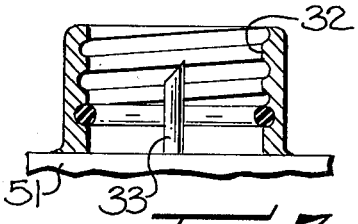
FIG. 7 is an enlarged, elevational, cross-sectional, detail of a portion of the apparatus illustrated in FIG. 3 and showing the connection of a disposable supply tank with the conduit means and valve means of the apparatus illustrated therein.

The inner and outer walls 23, 24 of the evaporator means 20 preferably comprises flexible and resilient material, such as the copper material discussed above, and defines therewithin the cylindrical receptacle 21 of slightly smaller diameter than the container C to be cooled. The inner and outer walls provide one or more slight longitudinal gaps therein, as shown in FIG. 4, so that the container C may be force fitted into the receptacle by radial expansion of the inner and outer walls to provide a close heat conducting relation between the container C and the evaporator means 20.

The portable apparatus 10 further includes a refrigerant supply tank 30 carried by the housing 11 and positioned within the other of the cavities 15 in the insulation 13 for initially containing a supply of pressurized refrigerant sufficient for cooling a plurality of containers C one at a time. The refrigerant supply tank 30, as shown in the first embodiments of portable apparatus 10 of FIGS. 1–11, may comprise a disposable tank 30 removably secured within the housing 11 of the apparatus 10 for being removed and replaced by another disposable supply tank 30 when the refrigerant therein is exhausted. For this purpose, the supply tank 30 may include a threaded neck portion **30*a* which has a rupturable membrane covering the end thereof for being received within a threaded member 32 having an upstanding member 33 which punctures the membrane in the neck portion 30*a* of the tank 30 when the tank 30 is screwed into the member 32 for allowing the flow of pressurized refrigerant from the tank 30, in a manner to be described below. Also, it is to be understood that the tank 30 could be a permanently secured, non-disposable tank, as will be described in connection with the second embodiment of portable apparatus 10′ illustrated in FIGS. 12–15.**

The tank 30 initially contains a suitable amount of refrigerant for cooling a plurality of the containers C, as mentioned above, and the refrigerant may be any relatively efficient, non-toxic, commercially available refrigerant, such as "Freon," carbon dioxide, etc. Such refrigerants are well known to those with ordinary skill in the art and additional description thereof is not believed necessary for the present invention.

The portable apparatus 10 further includes a metering tank 40 of a predetermined capacity for receiving a predetermined proportion of the refrigerant from the supply tank 30 for cooling a single container C.

The portable apparatus 10 also includes conduit means carried by the housing 11 and communicating with the refrigerant supply tank 30, the metering tank 40 and the evaporator means 20 for transmitting the pressurized refrigerant from the supply tank 30 to the metering tank 40 and from the metering tank 40 to the evaporator means 20. The conduit means is collectively referred to in the drawings by the reference numeral 45, and in the case of the use of a disposable refrigerant supply tank 30, the member 32 forms a part of the conduit 45.

The portable apparatus 10 further includes a valve means 50 carried by the housing 11 and forming a part of the conduit 45 and including means, to be described below, for actuating the valve means 50 to allow the flow of pressurized refrigerant from the supply tank 30 to the metering tank 40 while preventing the flow of refrigerant from the metering tank 40 to the evaporator 20, and means, to be described below, responsive to the flow of a predetermined quantity of refrigerant from the supply tank 30 to the metering tank 40 sufficient for cooling a single container C for deactuating the valve means 50 to stop the flow of pressurized refrigerant from the supply tank 30 to the metering tank 40 and to allow the flow of the predetermined quantity to refrigerant from the metering tank 40 to the evaporator 20 for cooling the container C received within the receptacle formed by the evaporator means 20.

The valve means 50 comprises a valve housing 51 having a longitudinally extending bore 52 therein. An inlet port 53 extends through the housing 51 and communicates with the portion of the conduit 45 leading from the pressurized refrigerant supply tank 30 and in the case of the disposable supply tank 30 illustrated in this embodiment, the inlet port 53 leads from the member 32 and the upstanding member 33. The valve 50 further includes a port 55 extending through the housing 51 from the bore 52 and communicates with the metering tank 40. An exit port 56 extends through the valve housing 51 from the bore 52 and communicates with the portion of the conduit 45 leading to the evaporator 20.

The ports 53, 55, 56 of the valve 50 are longitudinally spaced along the bore 52. A valve core 58 of the spool type is positioned in the bore 52 for being longitudinally shifted between an unactuated position (FIG. 8) and an actuated position (FIG. 9). In the actuated position (FIG. 9), the valve core 58 allows communication between the port 53 extending from the supply tank 30 and the port 55 extending to the metering tank 40 for allowing the flow of pressurized refrigerant from the supply tank 30 to the metering tank 40. In the unactuated position (FIG. 8) the valve core 58 allows communication between the port 55 leading from the metering tank 40 and the port 56 leading to the conduit 45 and evaporator 20 for allowing the flow of pressurized refrigerant from the metering tank 40 to the evaportor 20.

Figure 8:
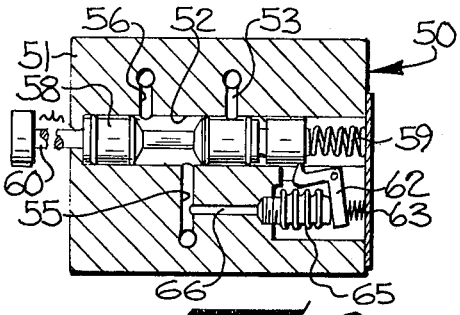
FIG. 8 is a cross-sectional view through the valve means of FIG. 3 and taken generally along the line 8—8 of FIG. 3 and illustrating the valve means in the deactuated position thereof.
Figure 9:
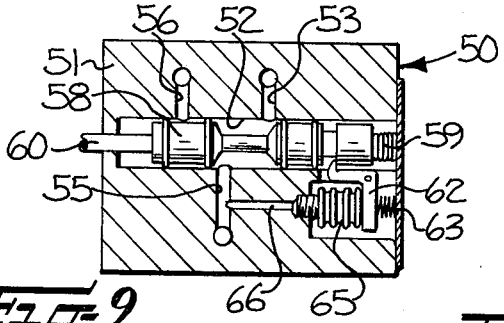
FIG. 9 is a view, like FIG. 8, illustrating the valve means in the actuated position thereof.
Figure 10:
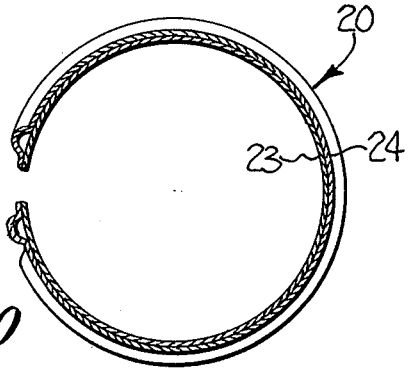
FIG. 10 is a cross-sectional view through the evaporator means of FIG. 4 and taken generally along the line 10—10 of FIG. 4.
Figure 11:
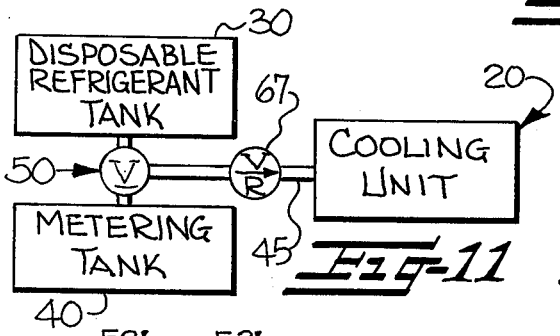
FIG. 11 is a schematic fluid flow diagram of the first form of the portable apparatus of this invention illustrated in FIGS. 1–10.

A spring 59 is positioned in the bore 52 of the valve 50 for biasing the valve core 58 into the unactuated position thereof (FIG. 8).

For actuating the valve 50, a manually depressable valve shifting device 60 is attached to the outer end of the valve core 58 and extends out of the housing 51 for being manually depressed by an operator of the portable apparatus 10 to shift the valve core 58 from the unactuated position thereof (FIG. 8) to the actuated position thereof (FIG. 9). The valve 50 further includes a latch member 62 pivotally mounted within a cavity in the valve housing 51 and biased by spring 63 into engagement with the valve core 58 so that when the valve core 58 is shifted by the manually depressable valve shifting member 60 into the actuated position thereof (FIG. 9), the latch member will be pivoted under the influence of spring 63 into engagement with a notch in the valve core 58 for holding the valve core 58 in the actuated position thereof (FIG. 9) against the bias of spring 59.

For automatically deactuating the valve 50 from the actuated position (FIG. 8) to allow the valve core 58 to return to its unactuated position (FIG. 8) under the influence of spring 59, there is provided a pressure sensitive, expandable, bellows device 65 positioned within the cavity of the valve housing 51 containing the latch 62 and having one end thereof in engagement with the latch 62 and having the other end thereof in communication with a port 66 extending from the port 55, so that when the valve means is in the actuated position thereof (FIG. 9) and communication is established between the port 55 from the metering tank 40 and the port 53 from the supply tank 30, pressurized fluid will be flowing from the supply tank 30 to the metering tank 40. As the metering tank fills up with pressurized refrigerant, the pressure in the metering tank and the pressure in the supply tank will begin to equalize and a predetermined pressure will be established through the valve 50 and the ports 53, 55. The bellows device 65 is designed such that it will expand under this perdetermined pressure to unlatch the latch member 62 when the predetermined pressure has been established indicating a predetermined quantity of pressurized fluid has flowed from the supply tank 30 to the metering tank 40. This expansion of the bellows mechanism under the predetermined pressure causes pivotal movement of the latch member 62 for unlatching the valve core 58 to allow the valve core 58 to return to its unactuated position (FIG. 8) and open communication between the metering tank 40 and the evaporator 20 through the ports 53, 55 to allow the predetermined quantity of pressurized refrigerant in the metering tank 40 to flow into the evaporator 20 for cooling the single container C received therein.

Figure 5:
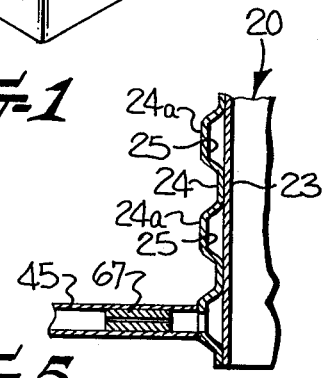
FIG. 5 is a cross-sectional detail of a portion of the apparatus illustrated in FIG. 3 and taken generally within the dotted rectangle 5 of FIG. 3.
Figure 3:
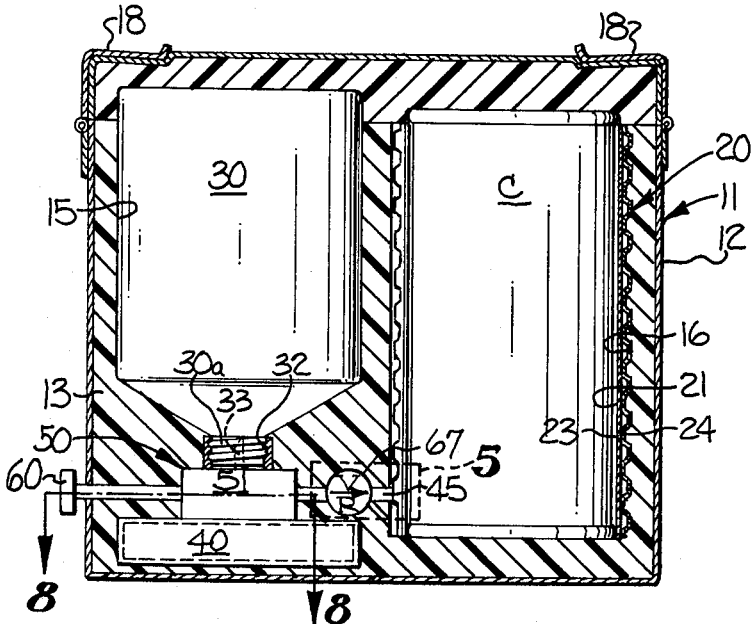
FIG. 3 is a somewhat enlarged, elevational, cross-sectional view of the apparatus of FIG. 1.

For purposes of moderating the flow of pressurized refrigerant into the evaporator means 20 when the valve 50 is deactuated, as discussed above, there is provided a flow restricting orifice device 67 in the conduit 45 at the entrance to the passageway 25 between the walls 23, 24 of the evaporator 20, as shown in FIG. 5.

Referring now to the second embodiment of portable apparatus 10′ for sequentially cooling a plurality of containers C of beverages and the like, as illustrated in FIGS. 12–15 of the drawings, elements of this second embodiment of portable apparatus 10′ which are substantially the same as those of the first embodiment of portable apparatus 10 will be indicated in these FIGS. 12–15 by the same reference numerals with a prime notation thereon and will not be described in detail hereinafter.

This second embodiment of portable apparatus 10′ of FIGS. 12–15 includes a housing 11′ of generally the same construction as that of the first embodiment. However, the top portion 17′ has been modified so that only a portion thereof is movable to open the cavity 16′ formed in the insulation 13′ containing the evaporator 20′ so as to open the receptacle formed by the evaporator 20′ for insertion and removal of a container C to be cooled. The supply tank 30′ of this second embodiment is permanently secured within the apparatus 10′ and to the valve 50′. With this permanently secured supply tank 30′, there is provided a port 30*a*′ extending therefrom and out of the housing 11′ for replenishing the supply of refrigerant within the tank 30′ when the refrigerant is exhausted. As mentioned above, the permanently secured supply tank 30′ may be utilized in the first embodiment of FIGS. 1–10 or the removable tank 30 of the first embodiment of FIGS. 1–10 could be utilized in the second embodiment of portable apparatus 10′ illustrated in FIGS. 12–15.

The main difference between the second embodiment of portable apparatus 10′ of FIGS. 12–15 and the first embodiment of portable apparatus 10 of FIGS. 1–11 is that the metering tank 40 of the first embodiment of apparatus 10 has been eliminated in the second embodiment of portable apparatus 10′ and the valve 50′ of the second embodiment has been modified.

Figure 13:
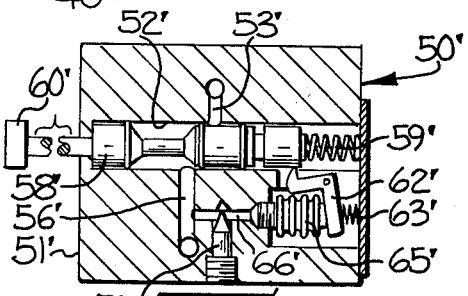
FIG. 13 is a cross-sectional view through the valve means of the apparatus of FIG. 12 and taken generally along the line 13—13 of FIG. 12 and illustrating the valve means in the deactuated position thereof.
Figure 12:
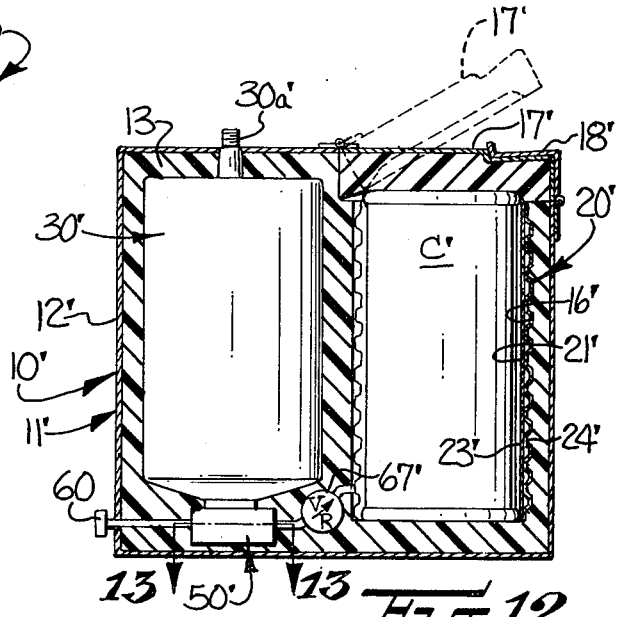
FIG. 12 is a cross-sectional, elevational view through a second form of portable apparatus in accordance with this invention.
Figure 14:
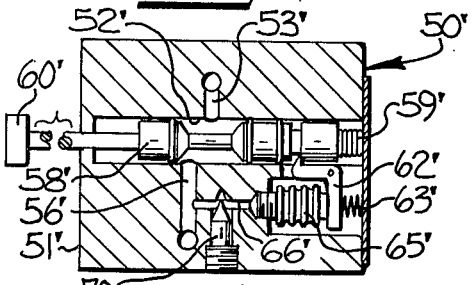
FIG. 14 is a view, like FIG. 13, illustrating the valve means in the actuated position thereof.
Figure 15:
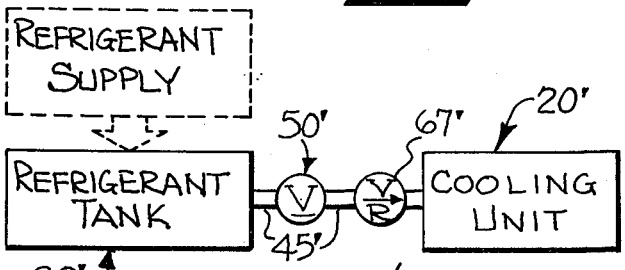
FIG. 15 is a schematic fluid flow diagram of the second form of the portable apparatus in accordance with this invention illustrated in FIGS. 12–14.

In this regard, the valve 50′ of the second embodiment of portable apparatus 10′ is illustrated specifically in FIGS. 13 and 14 in the deactuated and actuated positions, respectively. Since no metering tank 40 is utilized in this second embodiment of portable apparatus 10′, the valve means 50′ only includes an inlet port 53′ extending from the supply tank 30′ through the valve body 51′ to the bore 52′ of the valve 50′ and an exit port 56′ extending from the bore 52′ to the conduit 45′ leading to the evaporator 20′. As described above, these ports 53′, 56′ are longitudinally spaced along the bore 52′. The conduit 45′ also includes at the entrance to the evaporator means 20 a flow restricting orifice device 67′ which may be of the same construction as illustrated in FIG. 5 for restricting the flow of refrigerant into the evaporator 20′ and which causes an increasing back pressure to be built up through the conduit 45′ and the valve 50′ as the pressurized refrigerant flows from the supply tank 30′ into the evaporator 20′. This predetermined, increasing, back pressure will actuate the bellows device 65′ when a predetermined back pressure has been built up for unlatching the latch device 62′ to release the valve core 58′ to allow the valve core 58′ to return under the influence of spring 59′ to its unactuated position (FIG. 13).

Accordingly, in this second embodiment of portable apparatus 10′, the valve 50′ may be actuated by manually depressing the valve shifting device 60′ to shift the valve core 58′ against the influence of spring 59′ to open communication between ports 53;40 and 56′ to allow the flow of pressurized fluid from the supply tank 30′ through the conduit 45′ to the evaporator 20′ through the flow restricting orifice 67′. The valve core 58′ is held in this manually depressed actuated position by the latch member 62′ under the influence of its spring 63′ so that a predetermined back pressure will increasingly build up in the valve 50′ due to the flow restricting orifice 67' and will communicate with the bellows device 65' through the port 66' and the bellows device 65' will expand to pivot the latch mechanism 62' out of engagement with the valve core 58' to allow the valve core 58' to return to its unactuated position (FIG. 13) after a predetermined quantity of pressurized refrigerant has flowed from the supply tank 30' to the evaporator 20'. This closes communication between the ports 53', 56' and stops the flow of pressurized refrigerant from the supply tank 30'.

For regulating the amount of back pressure and thus the predetermined quantity of pressurized refrigerant to flow from the tank 30' to the evaporator 20', an adjustable valve 70, which may be of the screw needle type is provided in the port 66' to regulate the back pressure necessary to expand the bellows 65' to unlatch the latch 62'. Thus, the quantity of refrigerant flowing from the supply tank 30' to the evaporator 20' for the cooling of a single container C may be regulated.

Accordingly, it may be seen that this invention has provided two designs or embodiments with variables in each of a portable apparatus for sequentially cooling a plurality of containers of beverages and the like and has provided the subcombinations of a pressure responsive metering valve for allowing passage therethrough of a predetermined quantity of pressurized fluid and two designs of an apparatus for metering a predetermined quantity of pressurized fluid to any suitable device.

In the drawings and specification there have been set forth preferred embodiments of this invention, and although specific terms are employed, they are used in a generic and descriptive sense only and not for purposes of limitation.

What is claimed is:

1. A portable, open cycle, refrigeration apparatus for sequentially cooling containers of beverages and the like and having a capacity for a plurality of sequential cooling operations comprising:

a portable housing;

evaporator means carried by said housing for receiving and circulating a refrigerant therethrough during each cooling operation and including venting means for releasing the refrigerant after circulation to the atmosphere and defining therewithin a receptacle for recieving a container to be cooled in close heat-conducting relation thereto;

a refrigerant supply tank carried by said housing for initialy containing a supply of a pressurized refrigerant sufficient for a plurality of sequential cooling operations;

conduit means carried by said housing and communicating with said evaporator means and said refrigerant supply tank for transmitting the pressurized refrigerant from said tank to said evaporator means; and valve means carried by said housing and forming a part of said conduit means and including means for actuating said valve means to allow the flow of pressurized refrigerant from said refrigerant supply tank and pressure responsive means responsive to the flow of a predetermined quantity of less than the total supply of refrigerant from said supply tank sufficient for a single cooling operation for deactuating said valve means to stop the flow of refrigerant from said supply tank and provide the predetermined quantity of refrigerant to said evaporator for a single cooling operation.

2. A portable, open cycle, refrigeration apparatus, as set forth in claim 1, wherein said portable housing includes insulation surrounding said evaporator means and ports extending through said housing and communicating with said evaporator venting means, so that refrigerant released therefrom will flow into said insulation and out of said ports in said housing to the atmosphere for obtaining additional circulation of the refrigerant to enhance cooling.

3. A portable, open cycle, refrigeration apparatus, as set forth in claim 1, wherein said refrigerant supply tank comprises a disposable tank removably secured to said conduit means within said housing for being removed and replaced by another disposable supply tank when the refrigerant is exhausted.

4. A portable, open cycle, refrigeration apparatus, as set forth in claim 1, wherein said refrigerant supply tank comprises a permanent tank secured to said conduit means and including port means extending therefrom through said housing for replenishing the supply of refrigerant within said tank when the refrigerant is exhausted.

5. A portable, open cycle, refrigeration apparatus for sequentially cooling containers of beverages and the like and having a capacity for a plurality of sequential cooling operations comprising:

a portable housing;

evaporation means carried by said housing for receiving and circulating a refrigerant therethrough during each cooling operation and including venting means for releasing the refrigerant after circulation to the atmosphere and defining therewithin a receptacle for receiving the container to be cooled in close heat-conducting relation thereto;

a refrigerant supply tank carried by said housing for initially containing a supply of a pressurized refrigerant sufficient for a plurality of sequential cooling operations;

a metering tank carried by said housing for receiving a predetermined amount of refrigerant from said supply tank for a single cooling operation;

conduit means carried by said housing and communicating with said refrigerant supply tank, said metering tank and said evaporator means for transmitting the pressurized refrigerant from said supply tank to said metering tank and from said metering tank to said evaporator means; and valve means carried by said housing and forming a part of said conduit means and including means for actuating said valve means to allow the flow of pressurized refrigerant from said refrigerant supply tank to said metering tank while preventing the flow of refrigerant from said metering tank to said evaporator means and means responsive to the flow of a predetermined quantity of less than the total supply of refrigerant from said supply tank to said metering tank for deactuating said valve means to stop the flow of refrigerant from said supply tank to said metering tank and to allow the flow of the predetermined quantity of refrigerant from said metering tank to said evaporator means for a single cooling operation.

6. A portable, open cycle, refrigeration apparatus, as set forth in claim 5, wherein said valve means includes means biasing said valve means in the deactuated position thereof, said means for actuating said valve means comprises a manually depressable valve shifting means and a latch means for holding said valve means in the actuated position against the bias of said biasing means, and said means for deactuating said valve means comprises a pressure sensitive bellows means connected with said latch means and with said conduit means extending between said supply tank and said metering tank and being responsive to the equalizing of pressure between said supply tank and said metering tank when a predetermined quantity of pressurized refrigerant has flowed from said supply tank to said metering tank for unlatching said latch means to allow said valve to return under the influence of said biasing means to the unactuated position thereof.

7. A portable, open cycle, refrigeration apparatus for sequentially cooling containers of beverages and the like and having a capacity for a plurality of sequential cooling operations comprising:

a portable housing;

evaporator means carried by said housing for receiving and circulating a refrigerant therethrough during each cooling operation and including venting means for releasing the refrigerant after circulation to the atmosphere and defining therewithin a receptacle for receiving the container to be cooled in close heat-conducting relation thereto;

a refrigerant supply tank carried by said housing for initially containing a supply of pressurized refrigerant sufficient for a plurality of sequential cooling operations;

conduit means carried by said housing and communicating with said refrigerant supply tank and said evaporator means for transmitting the pressurized refrigerant from said supply tank to said evaporator means;

a fixed resistance orifice means in said conduit at the entrance to said evaporator means for resisting the flow of pressurized refrigerant therethrough and for creating an increasing back pressure in said conduit means as the pressurized refrigerant flows therethrough; and valve means carried by said housing and forming a part of said conduit means and including means for actuating said valve means to allow the flow of pressurized refrigerant from said supply tank to said evaporator means and pressure responsive means responsive to the predetermined back pressure created in said conduit means by the flow of a predetermined quantity less than the total supply of refrigerant from said supply tank to said evaporator means sufficient for a single cooling operation for deactuating said valve means to stop the flow of refrigerant from said supply tank to said evaporator means.

8. A portable, open cycle refrigeration apparatus for sequentially cooling containers of beverages and the like and having a capacity for a plurality of sequential cooling operations comprising:

a portable housing;

evaporator means carried by said housing for receiving and circulating a refrigerant therethrough during each cooling operation and including venting means for releasing the refrigerant after circulation to the atmosphere and defining therewithin a receptacle for receiving a container to be cooled in close heat-conducting relation thereto, said evaporator means comprises a substantially smooth and generally cylindrical inner wall and an outer wall extending substantially around said inner wall and being contiguous therewith and having undulations therein for forming with said inner wall a serpentine passageway for the flow of the refrigerant through said evaporator means, said evaporator means comprises a generally cylindrical shape slightly smaller in diameter than the container to be received therein, said evaporator means being formed of flexible and resilient material and defines slight longitudinally extending gap means therein so that the container may be force-fitted into said receptacle by radial expansion of said evaporator means to insure a close heat-conducting relation betwee the container and said evaporator means;

a refrigerant supply tank carried by said housing for initially containing a supply of a pressurized refrigerant sufficient for a plurality of sequential cooling operations;

conduit means carried by said housing and communicating with said evaporator means and said refrigerant supply tank for transmitting the pressurized refrigerant from said tank to said evaporator means; and valve means carried by said housing and forming a part of said conduit means and including means for actuating said valve means to allow the flow of pressurized refrigerant from said refrigerant supply tank and means responsive to the flow of a predetermined quantity of less than the total supply of refrigerant from said supply tank sufficient for a single cooling operation for deactuating said valve means to stop the flow of refrigerant from said supply tank and provide the predetermined quantity of refrigerant to said evaporator for a single cooling operation.

9. A portable, open cycle, refrigeration apparatus for sequentially cooling containers of beverages and the like and having a capacity for a plurality of sequential cooling operations comprising:

a portable housing;

evaporator means carried by said housing for receiving and circulating a refrigerant therethrough during each cooling operation and including venting means for releasing the refrigerant after circulation to the atmosphere and defining therewithin a receptacle for receiving a container to be cooled in close heat-conducting relation thereto;

a refrigerant supply tank carried by said housing for initially containing a supply of a pressurized refrigerant sufficient for a plurality of sequential cooling operations;

conduit means carried by said housing and communicating with said refrigerant supply tank and said evaporator means for transmitting the pressurized refrigerant from said supply tank to said evaporator means;

a fixed resistance orifice means in said conduit at the entrance to said evaporator means for resisting the flow of pressurized refrigerant therethrough and for creating an increasing back pressure in said conduit means as the pressurized refrigerant flows therethrough; and valve means carried by said housing and forming a part of said conduit means and including means for actuating said valve means to allow the flow of pressurized refrigerant from said supply tank to said evaporator means and pressure responsive means responsive to the predetermined back pressure created in said conduit means by the flow of a predetermined quantity less than the total supply of refrigerant from said supply tank to said evaporator means sufficient for a single cooling operation for deactuating said valve means to stop the flow of refrigerant from said supply tank to said evaporator means, said valve means includes means biasing said valve means in the deactuated position thereof, said means for actuating said valve means comprises a manually depressable valve shifting means and a latch means for holding said valve in the actuated position against the bias of said biasing means, said means for deactuating said valve means comprising a pressure sensitive bellows means connected with said latch means and with said conduit means and being responsive to a predetermined back pressure in said conduit means for unlatching said latch means to allow said valve means to return under the influence of said biasing means to the actuated position thereof.

10. A portable, open cycle, refrigeration apparatus, as set forth in claim 9, in which said means for deactuating said valve means further includes an adjustable flow resistance means between said conduit means and said bellows means for adjusting the amount of back pressure necessary for actuating said bellows means to unlatch said latch means for deactuating said valve means and thus control the quantity of refrigerant flowing from said supply tank to said evaporator means.

* * * * *

UNITED STATES PATENT AND TRADEMARK OFFICE

CERTIFICATE OF CORRECTION

PATENT NO. : 4,054,037

DATED : November 10, 1977

INVENTOR(S) : Michael C. Yoder

It is certified that error appears in the above-identified patent and that said Letters Patent are hereby corrected as shown below:

Column 2, line 12 "nat" should be --ant--; Column 3, line 58 "lind" should be --line--; Column 4, line 59, "preferred" should be --preferably--; Column 5, line 55, "embodiments" should be --embodiment--; Column 6, line 41 "to" should be --of--; Column 8, line 61 after "53" delete --;40--; Column 9, Claim 1, line 49, "initialy" should be --initially--; Column 10, Claim 5, line 28, "evaporation" should be --evaporator--; Column 12, Claim 8, Line 14 "betwee" should be --between--; Column 13, Claim 9, line 14, "comprising" should be --comprises--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*